US011937650B2

(12) United States Patent
Moylan

(10) Patent No.: US 11,937,650 B2
(45) Date of Patent: Mar. 26, 2024

(54) BRASSIERE AND GARMENT ACCESSORY

(71) Applicant: SHEFIT, INC., Hudsonville, MI (US)

(72) Inventor: Sara Marie Moylan, Jenison, MI (US)

(73) Assignee: SHEFIT, INC., Hudsonville, MI (US)

( * ) Notice: Subject to any disclaimer, the term of this patent is extended or adjusted under 35 U.S.C. 154(b) by 423 days.

(21) Appl. No.: 17/349,073

(22) Filed: Jun. 16, 2021

(65) Prior Publication Data

US 2022/0104557 A1 Apr. 7, 2022

Related U.S. Application Data

(63) Continuation-in-part of application No. 17/064,852, filed on Oct. 7, 2020, now abandoned.

(51) Int. Cl.
*A41C 3/00* (2006.01)

(52) U.S. Cl.
CPC ..... *A41C 3/0028* (2013.01)

(58) Field of Classification Search
CPC ..... A41C 3/0028; A41C 3/08; A41C 3/02; A41F 1/006
USPC ..... 450/30–33
See application file for complete search history.

(56) References Cited

U.S. PATENT DOCUMENTS 2,009,620 A * 7/1935 Jackson ..... A41F 15/00 2/73
4,781,650 A 11/1988 Budd
5,429,593 A * 7/1995 Matory ..... A61F 13/145 602/61
5,951,364 A * 9/1999 Brown ..... A41C 3/02 450/86
6,165,048 A * 12/2000 Russ ..... B24B 37/04 451/60
6,443,805 B1 9/2002 Kirkwood
6,530,820 B1 3/2003 Katze et al.
7,409,728 B2 8/2008 Harry
7,931,521 B1 * 4/2011 Griffin ..... A41F 15/002 450/86
8,172,639 B2 * 5/2012 Swendseid ..... A41C 3/0057 450/86
8,182,310 B2 5/2012 Clair et al.
8,267,740 B1 * 9/2012 Afxentiou ..... A41C 3/0021 450/86
8,506,347 B2 8/2013 Clair et al.
8,708,773 B2 * 4/2014 Afxentiou ..... A41C 3/0021 450/86
8,932,104 B2 1/2015 Moylan
9,022,833 B2 * 5/2015 Deming ..... A41D 13/1245 450/30
D779,164 S 2/2017 Dehlsen et al.
D790,802 S * 7/2017 Op't Hof ..... D2/703
9,993,036 B2 * 6/2018 Swendseid ..... A61F 13/00068
(Continued)

*Primary Examiner* — Gloria M Hale
(74) *Attorney, Agent, or Firm* — Price Heneveld LLP

(57) ABSTRACT

A bra includes an adjustable body strap that has a rear portion with first and second coupling features disposed on a single side thereof, and first and second support straps that are respectively coupled at one end to the rear portion of the body strap. Each of the first and second support straps includes a fastening material, first and second fabric materials, and a flexibly resilient material. The first fabric, the flexibly resilient material, the second fabric, and the fastening material are integrally formed to define a laminated support strap of each of the first and second support straps.

18 Claims, 12 Drawing Sheets

(56) References Cited

U.S. PATENT DOCUMENTS

| | | | | |
|---|---|---|---|---|
| 10,786,382 | B2 * | 9/2020 | Shagdar | A61B 5/1116 |
| 10,986,881 | B2 * | 4/2021 | Stanton | A41C 3/0064 |
| 2013/0027302 | A1 * | 1/2013 | Iwaizumi | G06F 1/1686 345/158 |
| 2021/0298367 | A1 * | 9/2021 | Song | A41C 3/0064 |
| 2022/0104557 | A1 * | 4/2022 | Moylan | A41C 3/0028 |

* cited by examiner

BRASSIERE AND GARMENT ACCESSORY

CROSS REFERENCE TO RELATED APPLICATION

The present application is a continuation-in-part of U.S. patent application Ser. No. 17/064,852 entitled "BRASSIERE AND GARMENT ACCESSORY," filed Oct. 7, 2020, now abandoned, which is incorporated herein by reference in its entirety.

BACKGROUND OF THE DISCLOSURE

The present disclosure generally relates to a brassiere and garment accessory, and more specifically, to a garment accessory that can be suspended from adjustable straps of the brassiere.

SUMMARY OF THE DISCLOSURE

According to one aspect of the present disclosure, a garment system including a bra and garment configured to couple to the bra. The bra includes first and second breast cups that are laterally spaced-apart and include respective upper edges. First and second attachment clips are disposed on the upper edges of the first and second breast cups, respectively, and each include a receiving aperture disposed therethrough. A body strap is operably coupled to the first and second breast cups along a front portion of the body strap. The body strap further includes a rear portion configured to extend around a back of a wearer. First and second support straps are respectively attached at one end to the rear portion of the body strap, and each include a free end having a first coupling feature and a body portion having a second coupling feature that is a reciprocal coupling feature to the first coupling feature. The free ends of the first and second support straps are received through the receiving apertures of the first and second attachment clips, respectively, such that the free ends of the first and second support straps can be folded back against themselves. In this way, the first and second coupling features of the first and second support straps can be aligned and releasably couple to one another. The garment includes a tubular body portion having an upper edge extending around the tubular body portion. First and second fasteners are laterally spaced-apart from one another and each include an anchor portion operably coupled proximate to the upper edge of the tubular body portion. The first and second fasteners each include a coupling portion extending upwardly from the anchor portion to define upwardly accessible first and second receiving apertures, respectively. The first and second support straps are received through the first and second receiving apertures, respectively, to releasably couple the garment to the bra.

According to another aspect of the present disclosure, a garment includes a front panel and a rear panel operably coupled to one another and cooperating to define a tubular body portion with an upper edge. The upper edge includes front and rear portions. The rear portion of the upper edge is disposed along the rear panel and downwardly drapes between the first and second sides of the tubular body portion. A fastener includes an anchor portion defining a mounting aperture and a coupling portion defining a receiving aperture disposed above the mounting aperture. A material tab includes first and second ends and a body portion disposed therebetween. The first end of the material tab is operably coupled to the tubular body portion proximate the front portion of the upper edge of the tubular body portion.

The second end of the material tab is coupled to either the tubular body portion proximate the front portion of the upper edge of the tubular body portion, or the body portion of the material tab itself. The body portion of the material tab is received through the mounting aperture of the fastener.

According to yet another aspect of the present disclosure, a garment includes a tubular body portion having front, rear and opposed side portions and an upper edge extending circumferentially around the tubular body portion. The upper edge includes front and rear portions. First and second fasteners each include an anchor portion operably coupled proximate to the front portion of the upper edge of the tubular body portion at laterally spaced-apart first and second attachment locations, respectively. The first and second fasteners further include coupling portions extending upwardly from the respective anchor portions to define upwardly accessible receiving apertures disposed through the respective coupling portions. The rear portion of the upper edge of the tubular body portion is disposed in a U-shaped configuration between the laterally spaced-apart first and second attachment locations of the first and second fasteners.

According to another aspect of the present disclosure, a bra includes first and second cups that are laterally spaced-apart and each have upper edges. A body strap is operably coupled to the first and second cups along a front portion of the body strap. The body strap further includes a rear portion that is configured to extend around a back of a wearer. First and second support straps are respectively coupled at one end to the rear portion of the body strap. The first and second support straps each include a free end having a first coupling feature, and a body portion that has a second coupling feature that is a reciprocal coupling feature to the first coupling feature. The free ends of the first and second support straps can be folded back against the body portions, such that the first and second coupling features of the first and second support straps are aligned and releasably coupled to one another. The first and second support straps further include first and second fabrics, a flexibly resilient material, and a fastening material that includes the first and second coupling features. The first fabric, the flexibly resilient material, the second fabric, and the fastening material are integrally formed to define a laminated support strap of each of the first and second support straps.

According to another aspect of the present disclosure, a bra assembly includes at least one cup. A body strap is operably coupled to the at least one cup. A first laminated support strap is selectively coupled to the at least one cup. The laminated support strap includes a free end, a body portion that extends from the free end and is coupled to the body strap at an opposing end from the free end, first and second fabrics, and a fastening material. The first fabric, the second fabric, and the fastening material are integrally formed to define the laminated support strap.

According to yet another aspect of the present disclosure, a bra includes an adjustable body strap that has a rear portion with first and second coupling features disposed on a single side thereof, and first and second support straps that are respectively coupled at one end to the rear portion of the body strap. Each of the first and second support straps includes a fastening material, first and second fabric materials, and a flexibly resilient material. The first fabric, the flexibly resilient material, the second fabric, and the fastening material are integrally formed to define a laminated support strap of each of the first and second support straps.

These and other features, advantages, and objects of the present disclosure will be further understood and appreciated by those skilled in the art by reference to the following specification, claims, and appended drawings.

The components in the figures are not necessarily to scale, emphasis instead being placed upon illustrating the principles described herein.

DETAILED DESCRIPTION

Figure 1A:
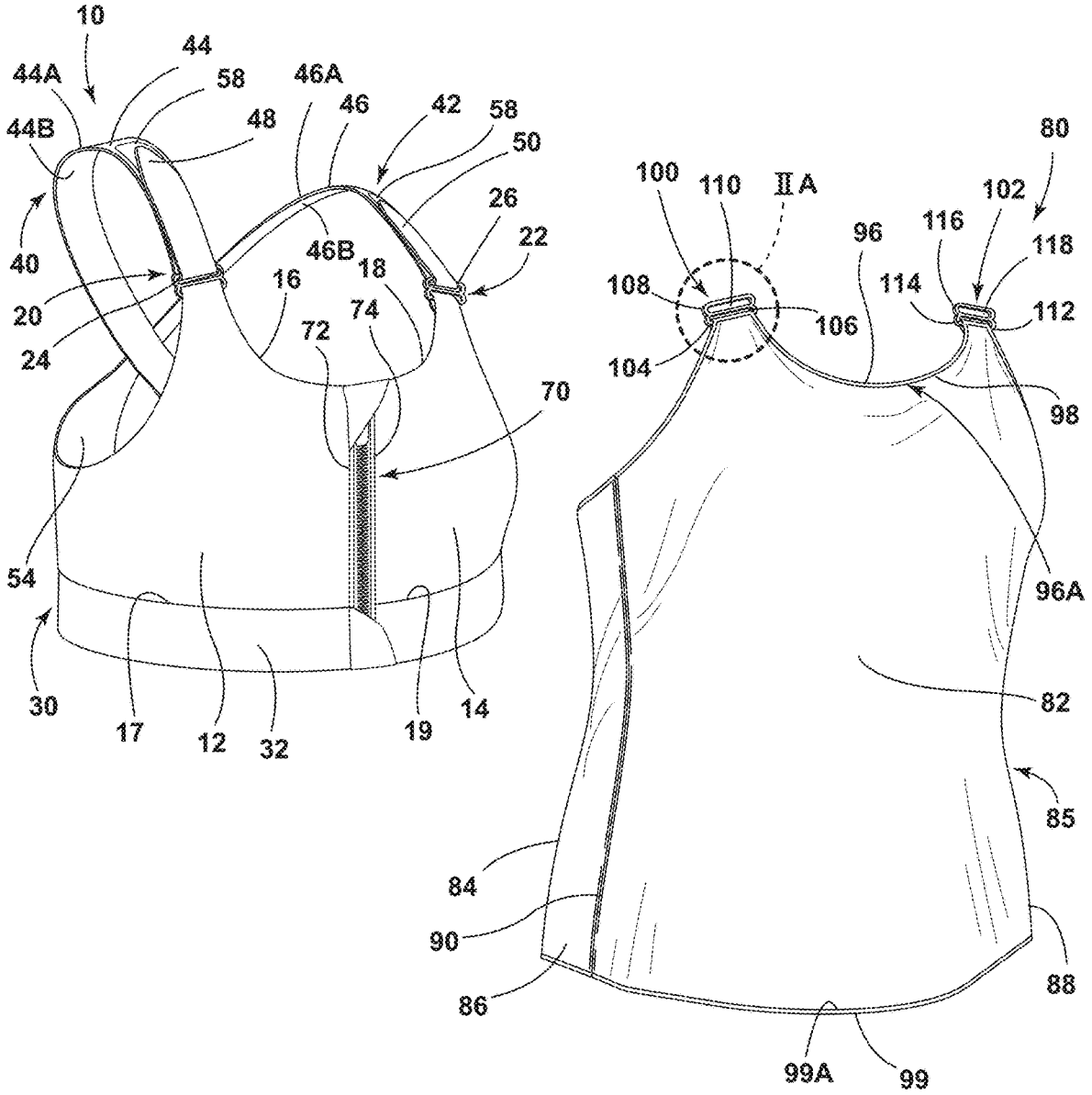
FIG. 1A is a front perspective view of a brassiere exploded away from a garment accessory.

For purposes of description herein, the terms "upper," "lower," "right," "left," "rear," "front," "vertical," "horizontal," and derivatives thereof shall relate to the disclosure as oriented in FIG. 1A. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring now to FIG. 1A, the reference numeral 10 generally indicates a brassiere as used with, and as part of, the present concept. The brassiere 10 may be referred to herein as a bra or sports bra. The bra 10 includes first and second breast cups 12, 14 that are laterally spaced-apart from one another on a front portion of the bra 10. Each of the breast cups 12, 14 include respective upper edges 16, 18 and respective lower edges 17, 19. In use, the first and second breast cups 12, 14 are configured to cup and support the breast of a wearer of the bra 10. The first and second breast cups 12, 14 may be comprised of a flexibly resilient or cushioning material to provide a more comfortable and supportive fit.

As further shown in FIG. 1A, first and second attachment clips 20, 22 are disposed on the upper edges 16, 18 of the first and second breast cups 12, 14, respectively. The first and second attachment clips 20, 22 are laterally spaced-apart and each include a receiving aperture 24, 26, respectively. The receiving apertures 24, 26 are disposed through the first and second attachment clips 20, 22 and are upwardly accessible.

As further shown in FIG. 1A, the bra 10 includes a body strap 30 operably coupled to the first and second breast cups 12, 14 along the lower edges 17, 19 thereof. Specifically, the body strap 30 includes a front portion 32 and a rear portion 34 (FIG. 3), wherein the front portion 32 is configured to wrap around the front of the wearer, and the rear portion 34 is configured to extend around the back of a wearer at the torso level. The body strap 30 is contemplated to be an adjustable strap, as further described below.

As further shown in FIG. 1A, the bra 10 includes first and second support straps 40, 42 which, as shown in FIG. 1A, are contemplated to be adjustable shoulder straps configured to support the bra 10 over the shoulders of a wearer. As shown in FIG. 1A, the first and second support straps 40, 42 each include a respective free end 48, 50 and a respective first end 52, 54 (FIG. 3) with respective body portions 44, 46 positioned therebetween. The body portions 44, 46 each include first and second sides 44A, 44B and 46A, 46B, respectively.

Figure 1B:
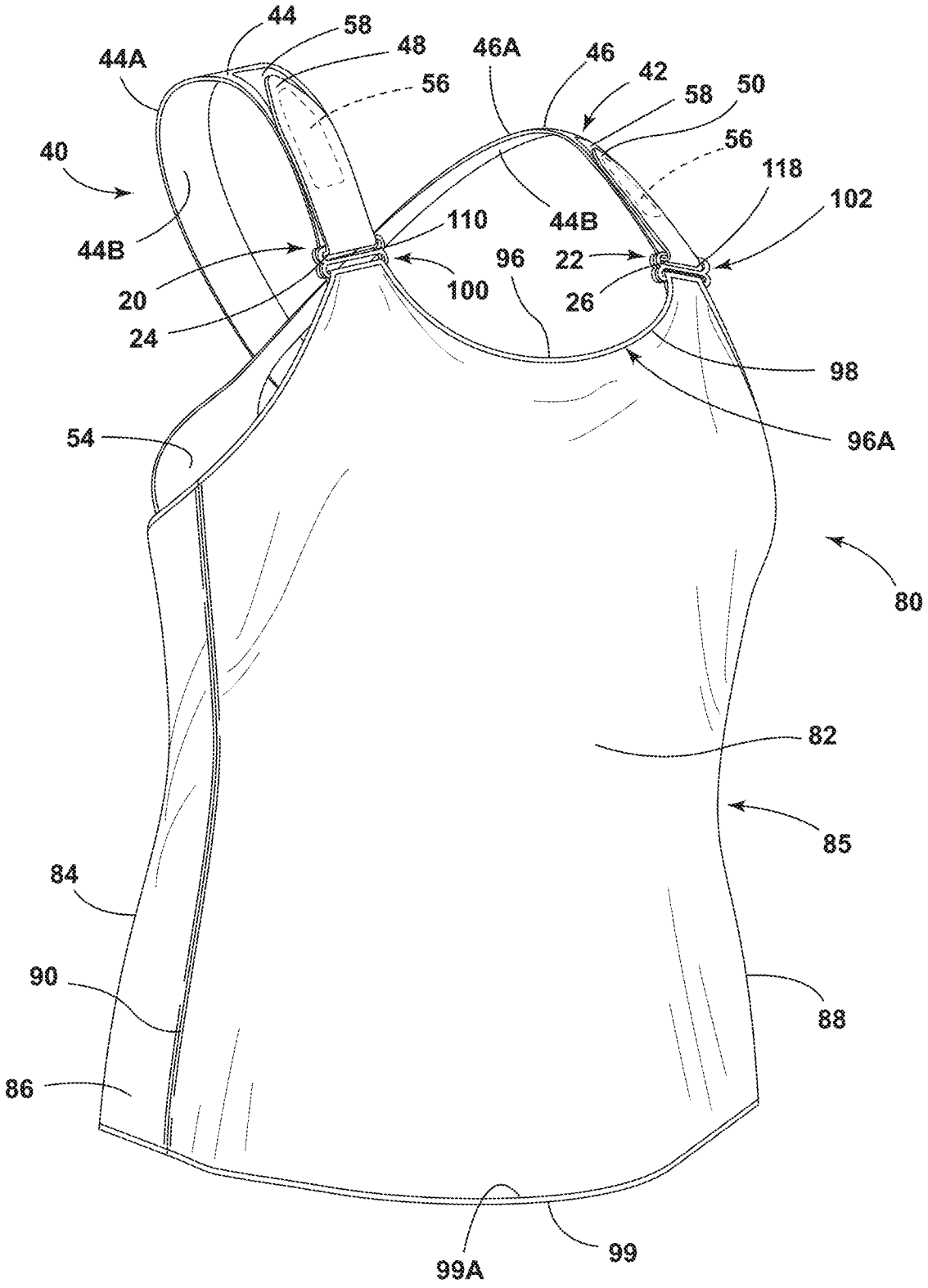
FIG. 1B is a bottom perspective view of the brassiere and garment accessory of FIG. 1A, with the garment accessory coupled to adjustable straps of the brassiere.

Referring now to FIG. 1B, the free ends 48, 50 of the first and second support straps 40, 42 each include a first coupling feature 56. As further shown in FIG. 1B, the body portions 44, 46 of the first and second support straps 40, 42 each include a second coupling feature 58 that is contemplated to be a reciprocal coupling feature to the first coupling feature 56. In this way, the first and second coupling features 56, 58 of the first and second support straps 40, 42 can be releasably coupled to one another. It is contemplated that a hook and loop fastening system may be used for the first and second coupling features 56, 58, or other like coupling system. Thus, in use, the free ends 48, 50 of the first and second support straps 40, 42 are contemplated to be received through the respective receiving apertures 24, 26 of the first and second attachment clips 20, 22, such that the free ends 48, 50 of the first and second support straps 40, 42 can be folded back against themselves to align with select portions of the respective body portions 44, 46. In this way, the first and second coupling features 56, 58 of the first and second support straps 40, 42 are aligned and can be releasably coupled to one another, as shown in FIG. 1B. It is further contemplated that the entire first sides 44A, 46A, may be comprised of a material suitable as the second coupling feature 58. Thus, the body portions 44, 46 of the first and second support straps 40, 42 may be comprised of a fabric that includes a coupling feature, such as loop coupling feature, that is reciprocal to the first coupling feature 56. Further, the first and second support straps 40, 42 may be configured in such a way that the first and second coupling features 56, 58 are disposed on the second sides 44B, 46B of the body portions 44, 46, respectively. In such a configuration, the free ends 48, 50 of the first and second support straps 40, 42 can be folded under the body portions 44, 46 to align the first and second coupling features 56, 58 with one another. In such a configuration, the second sides 44B, 46B of the respective body portions 44, 46 may be comprised entirely of a reciprocal coupling feature material, or include a select section in which the second coupling feature 58 is disposed. It is further contemplated that the first and second sides 44A, 44B and 46A, 46B of the first and second support straps 40, 42 can be substantially covered by the respective second coupling features 58. The terms "substantial," "substantially," and variations thereof as used herein are intended to note that a described feature is equal or approximately equal to a value or description. For example, a first article that "substantially covers" a second article is intended to denote an article that completely covers or approximately covers the second article. Moreover, "substantially" is intended to denote that two values are equal or approximately equal. In some embodiments, "substantially" may denote values within about 10% of each other, such as within about 5% of each other, or within about 2% of each other. As further shown in FIG. 1B, the front panel 82 of the garment 80 substantially covers the first and second breast cups 12, 14 of the bra 10, thereby conceal, or substantially concealing the first and second breast cups 12, 14.

Figure 3:
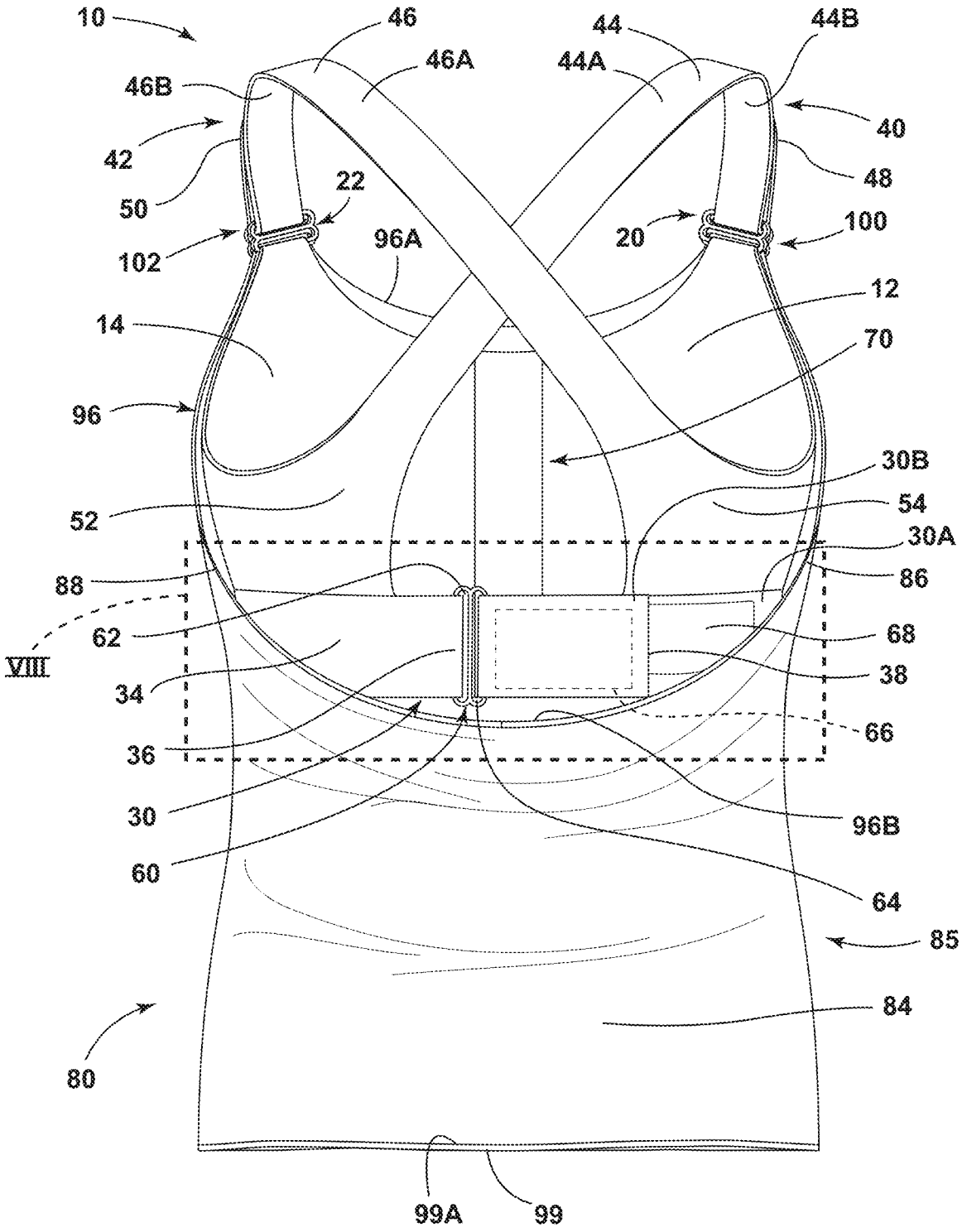
FIG. 3 is a rear elevation view of the brassiere and garment accessory of FIG. 1B.

Referring now to FIG. 3, the body strap 30 is illustrated as an adjustable strap having a first end 36 and an elongate second end 38. The first end 36 and the elongate second end 38 of the body strap 30 makeup the rear portion 34 of the body strap 30. The first end 36 is shown in FIG. 3 as being received through a first receiving aperture 62 of an attachment clip 60. It is contemplated that the first end 36 is fixedly coupled to the attachment clip 60 at the first receiving aperture 62 thereof. The elongate second end 38 of the body strap 30 is a free end and is illustrated in FIG. 3 as being releasably received through a second receiving aperture 64 of the attachment clip 60. In this way, the elongate second end 38 of the body strap 30 can fold over onto the body strap 30 to align and releasably couple corresponding coupling features 66, 68 respectively disposed on a distal portion of the elongate second end 38 and the rear portion 34 of the body strap 30, respectively. Again, a hook and loop style fastening system may be used for the corresponding coupling features 66, 68 of the body strap 30 which are contemplated to be reciprocal or complementary coupling features. The body strap 30 includes first and second sides 30A, 30B, with the first and second coupling features 66, 68 disposed on the first side thereof in FIG. 3. It is further contemplated that the entire first side 30A may be comprised of a material suitable as the second coupling feature 68. Thus, the entire first side 30A of the body strap 30 may be comprised of a fabric that includes a coupling feature, such as loop coupling feature, that is reciprocal to the first coupling feature 66, as opposed to a select portion of the body strap 30 having the second coupling feature 68. As further shown in FIG. 3, the first and second support straps 40, 42 are shown as crossing over one another and attaching to the body strap 30 adjacent to the respective first end 36 and the elongate second end 38 of the body strap 30 at the first ends 52, 54 of the first and second support straps 40, 42. It is also contemplated that the first and second support straps 40, 42 may be configured in such a way that they do not crossover one another. In such an embodiment, the first ends 52, 54 of the first and second support straps 40, 42 would couple to the body strap 30 adjacent to the elongate second end 38 and the first end 36 of the body strap 30, respectively.

Referring again to FIG. 1A, the bra 10 may include a coupling mechanism 70 for releasably coupling inner edges 72, 74 of the first and second breast cups 12, 14 to one another. While the coupling mechanism 70 is shown in the form of a zipper mechanism, it is contemplated that any fastening system may be used to releasably couple the first and second breast cups 12, 14 at the inner edges 72, 74 thereof. In this way, the bra 10 provided with the present concept is a multi-way adjustable apparatus configured to provide maximum comfort, support and customization to the wearer. A bra having similar features as the present bra 10 is disclosed in U.S. Pat. No. 8,932,104, which is hereby incorporated by reference in its entirety.

With further reference to FIG. 1A, a garment 80 is shown which may be referred to herein as a tank top accessory or garment accessory. The garment 80 is configured to be releasably coupled to the bra 10 at the first and second support straps 40, 42, as further described below. The garment 80 includes a front panel 82 and a rear panel 84 which are operably coupled to one another to define a tubular body portion 85. Specifically, the front and rear panels 82, 84 are coupled to one another along first and second side portions 86, 88 of the tubular body portion 85 at seams 90, 92 (FIGS. 4 and 5), respectively. Together, the front panel 82 and rear panel 84 of the garment 80 cooperate to define the tubular body portion 85. The tubular body portion 85 includes an upper edge 96 having front and rear portions 96A, 96B (FIGS. 1A and 3 respectively) disposed circumferentially around the tubular body portion 85. The rear portion 96B of the upper edge 96 of the tubular body portion 85 is disposed along the rear panel 84 and downwardly drapes between the first and second side portions 86, 88 of the tubular body portion 85, as best shown in FIG. 3.

As further shown in FIG. 1A, the upper edge 96 of the tubular body portion 85 includes a hemline 98 disposed therearound. The tubular body portion 85 further includes a lower edge 99 have a hemline 99A disposed therearound. The upper edge 96 of the tubular body portion 85 further includes first and second fasteners 100, 102 that are spaced along the upper edge 96 of the tubular body portion 85 at laterally spaced-apart first and second attachment locations. With specific reference to the first fastener 100, the first fastener 100 includes an anchor portion 104 operably coupled to the tubular body portion 85 proximate to the upper edge 96 of the tubular body portion 85. Specifically, the anchor portion 104 of the first fastener 100 includes a mounting aperture 106 for receiving a portion of the tubular body portion 85 of the garment 80 therethrough, as further described below. In this way, the first fastener 100 is contemplated to be fixedly coupled to the upper edge 96 of the tubular body portion 85. The first fastener 100 further includes a coupling portion 108 which extends upwardly from the anchor portion 104 to define a receiving aperture 110 that is disposed above the mounting aperture 106 of the anchor portion 104. The receiving aperture 110 is upwardly accessible for coupling the garment 80 to the bra 10, as further described below. Turning now to the second fastener 102, the second fastener 102 includes an anchor portion 112 operably coupled to the tubular body portion 85 proximate to the upper edge 96 of the tubular body portion 85 and is laterally spaced-apart from the first fastener 100. In a manner similar to the first fastener 100, the anchor portion 112 of the second fastener 102 includes a mounting aperture 114 for receiving a portion of the tubular body portion 85 of the garment 80 therethrough. In this way, the second fastener 102 is also contemplated to be fixedly coupled to the upper edge 96 of the tubular body portion 85. The second fastener 102 further includes a coupling portion 116 which extends upwardly from the anchor portion 112 to define a receiving aperture 118 of the coupling portion 116 that is disposed above the mounting aperture 114 of the anchor portion 112. The receiving aperture 118 of the second fastener 102 is also upwardly accessible for coupling the garment 80 to the bra 10, as further described below.

Figure 1C:
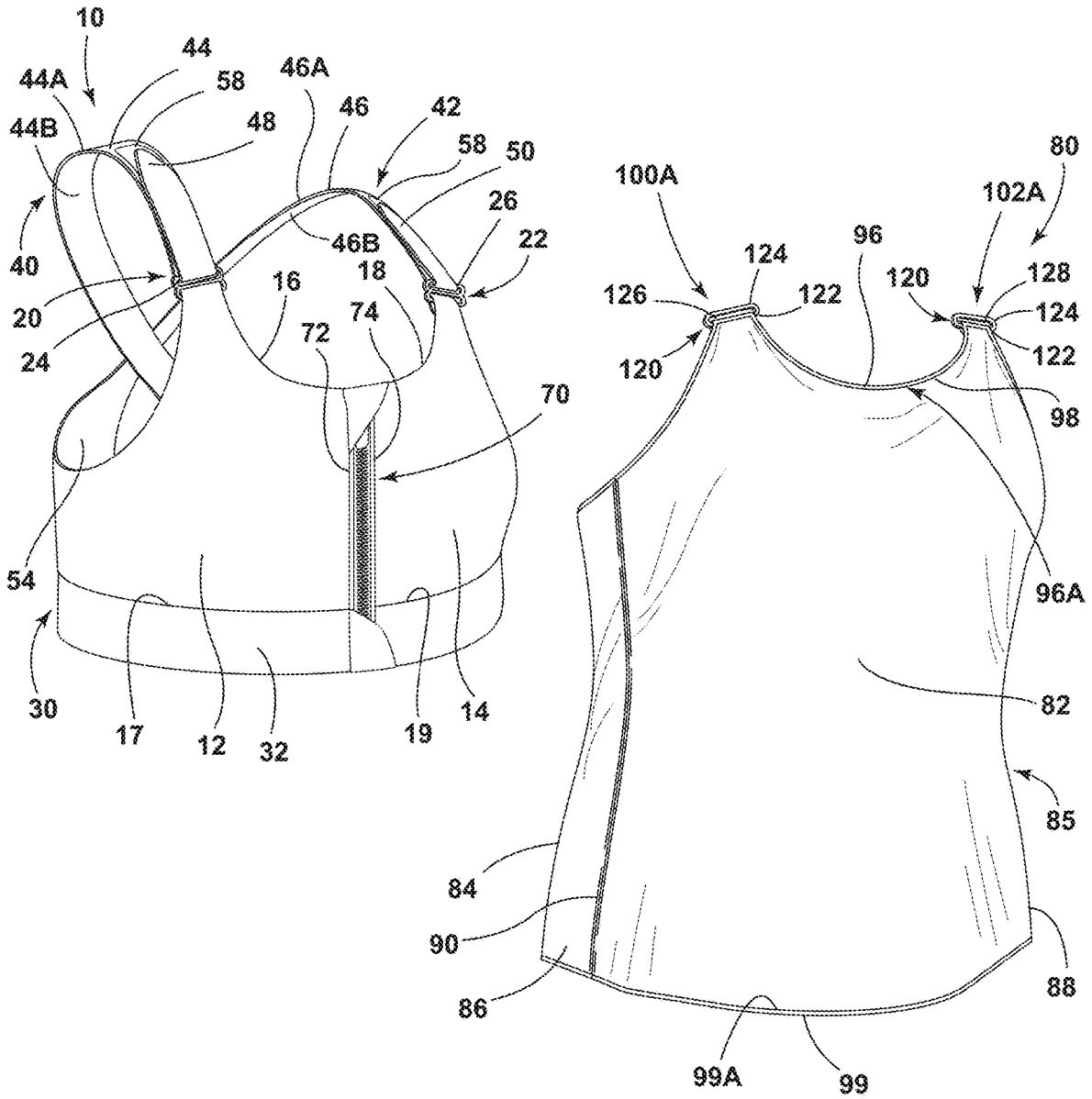
FIG. 1C is a bottom perspective view of the brassiere of FIG. 1A and another garment accessory exploded away therefrom.

In the embodiment shown in FIG. 1C, it is contemplated that the first and second fasteners 100, 102 of the garment 80 may be constructed and configured in a similar manner as the first and second attachment clips 20, 22 of the bra 10. With reference to the embodiment shown in FIG. 1C, first and second fasteners 100A, 102A are shown as an alternative embodiment to first and second fasteners 100, 102 shown in FIG. 1A. With specific reference to first fastener 100A, which will also describe second fastener 102A, an anchor portion 122 cooperates with a coupling portion 124 to define a ring member 120 having an upwardly accessible receiving aperture 126. The anchor portion 122 is operably coupled to the tubular body portion 85 proximate to the upper edge 96 of the tubular body portion 85 by receiving a portion of the tubular body portion 85 of the garment 80 therethrough. In this way, the first fastener 100A is contemplated to be fixedly coupled to the upper edge 96 of the tubular body portion 85, with the receiving aperture 126 thereof being used to couple the first fastener 100A to the garment 80, and also being upwardly accessible for receiving the first support strap 40 of the bra 10 to suspend the garment 80 from the bra 10. The second fastener 102A also includes an upwardly accessible receiving aperture 128 that is also upwardly accessible for coupling the garment 80 to the bra 10, as further described below. Thus, the first and second fasteners 100A and 102A of FIG. 1C include a single loop configuration as compared to the double loop configuration of first and second fasteners 100, 102 of FIG. 1A.

As noted above, the garment 80 is configured to be operably coupled to the bra 10 in a selective of releasable manner, such that the garment 80 can be suspended or otherwise supported from the bra 10. With the bra 10 being multi-way customizable and adjustable, the bra 10 serves as a suitable article for supporting the garment 80 given its secure position on the wearer. Specifically, the bra 10 is supported over the shoulders of the wearer by the first and second support straps 40, 42, and also includes the body strap 30 which cinches around the torso of the wearer. Both the first and second support straps 40, 42 and the body strap 30 are adjustable components to provide a custom fit with maximum comfort and support.

Figure 2A:
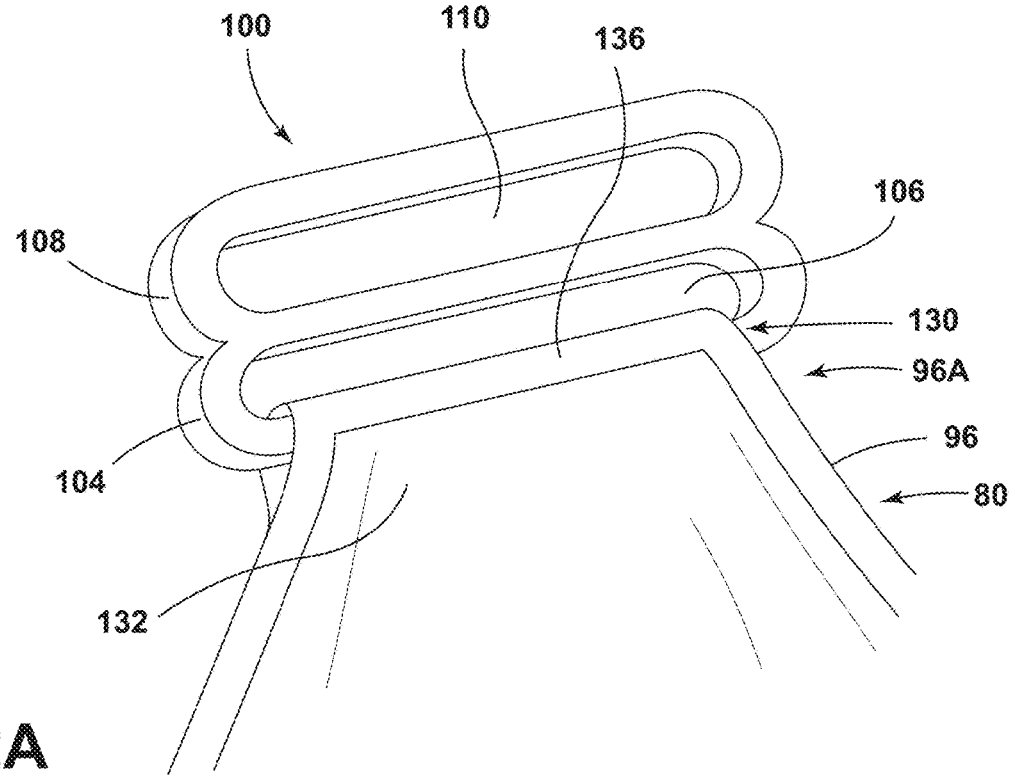
FIG. 2A is a bottom perspective zoomed-in front view of a fastener of the garment accessory of FIG. 1A taken at location IIA in FIG. 1A.
Figure 2B:
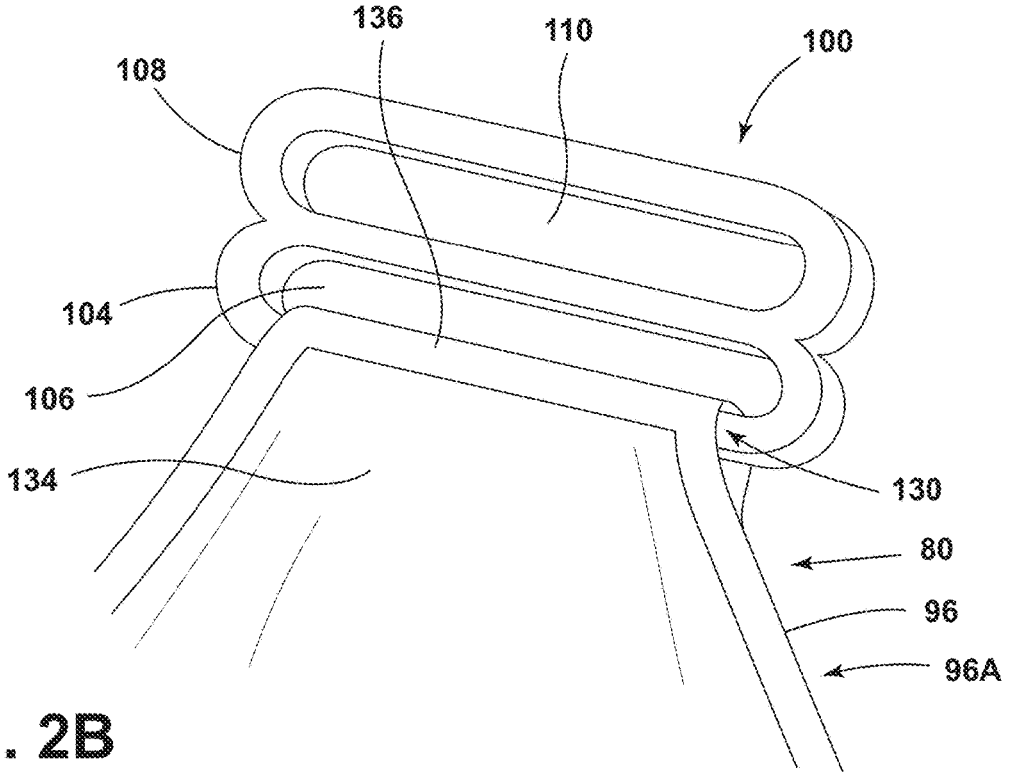
FIG. 2B is a rear view of the fastener and garment accessory of FIG. 2A.

Referring now to FIGS. 2A and 2B, the first fastener 100 is shown as coupled to the garment 80 at the upper edge 96 of the tubular body portion 85 of the garment 80. The first fastener 100, much like the second fastener 102, is contemplated to be fixedly coupled to the garment 80 by a material tab 130 having first and second ends 132, 134 and a body portion 136 disposed therebetween. The first end 132 of the material tab 130 is operably coupled to the tubular body portion 85 proximate the front portion 96A of the upper edge 96 of the tubular body portion 85 of garment 80, as shown in FIG. 2A. The second end 134 of the material tab 130 is operably coupled to the tubular body portion 85 proximate the front portion 96A of the upper edge 96 of the tubular body portion 85 of garment 80 on an opposite side of the garment 80, as shown in FIG. 2B. The second end 134 of the material tab 130 may also be operably coupled to the body portion 136 of the material tab 130 itself in assembly. As shown in FIGS. 2A and 2B, the body portion 136 of the material tab 130 is received through the mounting aperture 106 of the coupling portion 108 of the first fastener 100. In this way, the first fastener 100 is fixedly retained along the upper edge 96 of the garment 80. A similar coupling arrangement is contemplated for the second fastener 102 with respect to the garment 80.

Figure 2C:
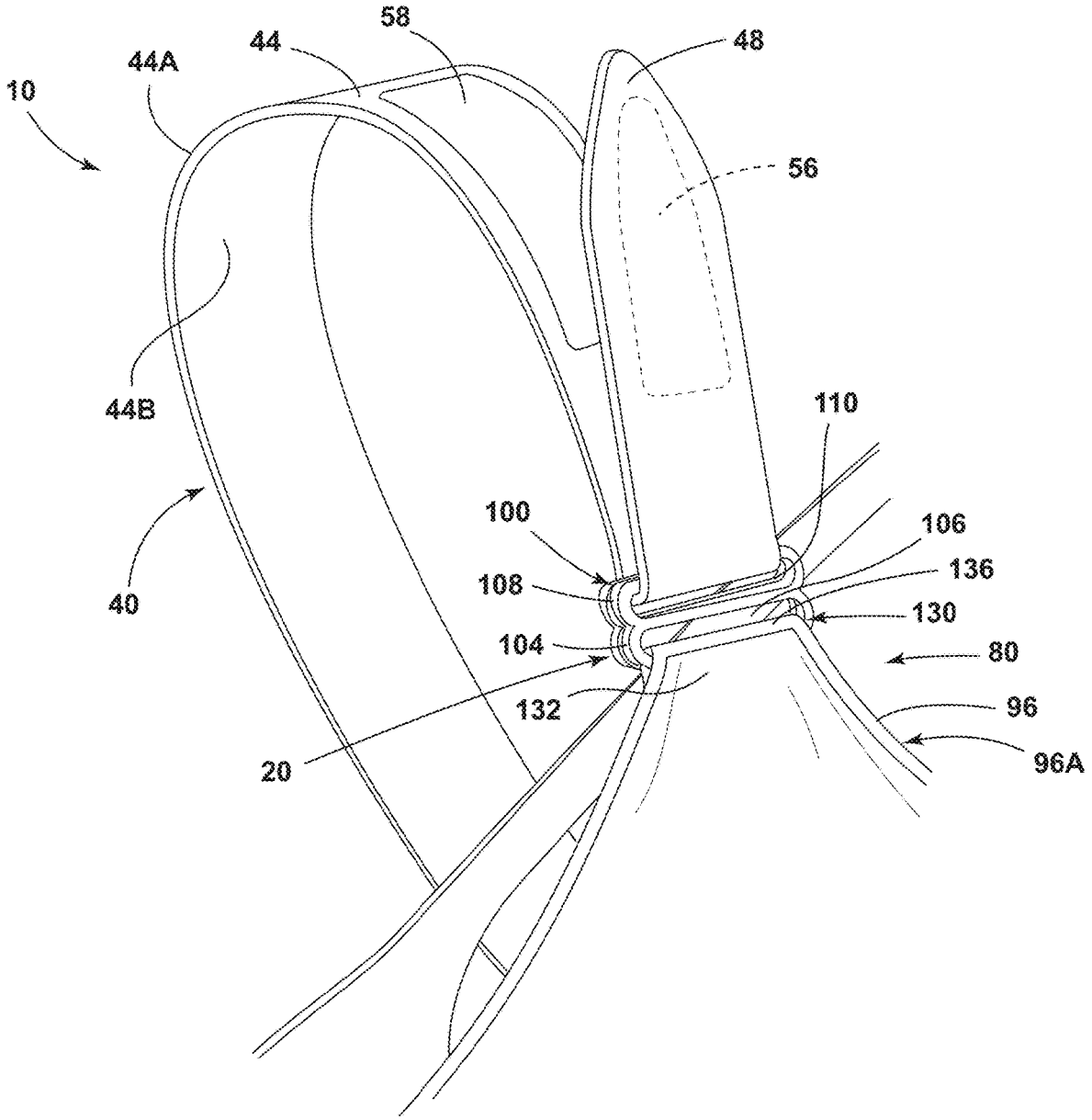
FIG. 2C is a front view of the fastener and garment accessory of FIG. 2A with a free end of a support strap of a brassiere received through the fastener.

Referring now to FIG. 2C, the free end 48 of the first support strap 40 is shown as being received through the receiving aperture 110 of the coupling portion 108 of the first fastener 100. As shown in FIG. 2C, the free end 48 of the first support strap 40 is folding back against the body portion 44 of the first support strap 40. In this way, the first coupling feature 56 and the second coupling feature 58 of the first support strap 40 are brought into alignment for a coupling arrangement therebetween when one contacts the other. In this way, the first support strap 40 can be received through the receiving aperture 24 of the attachment clips 20 of the bra 10, as shown in FIG. 1A, and can also be received through the receiving aperture 110 of the first fastener 100 to support the garment 80 from the first support strap 40. A similar configuration is contemplated for use in coupling the second support strap 42 to both the second attachment clip 22 of the bra 10, as well as the second fastener 102 of the garment 80.

As disposed above the anchor portions 104, 112, the receiving apertures 110, 118 of the first and second fasteners 100, 102 define upwardly accessible first and second receiving apertures 110, 118. The receiving apertures 110, 118 are defined as "upwardly accessible" receiving apertures, as they are disposed along the uppermost portion of the garment 80, at the upper edge 96 thereof. Being upwardly accessible, the receiving apertures 110, 118 of the first and second fasteners 100, 102 provide laterally spaced-apart connecting locations to releasably couple the garment 80 to the bra 10.

Referring now to FIG. 3, the bra 10 and the garment 80 are shown as coupled to one another and illustrated from a rear view. The upper edge 96 of the tubular body portion 85 of the garment 80 is shown as extending around the tubular body portion 85 of the garment 80 in a circumferential manner. Specifically, the rear portion 96B of the upper edge 96 of the tubular body portion 85 is disposed along the rear panel 84 of the garment 80 and downwardly drapes between the opposed first and second sides 86, 88 of the tubular body portion 85. In this way, the rear portion 96B of the upper edge 96 of the tubular body portion 85 is disposed in a U-shaped configuration. As further shown in FIG. 3, the upper edge 96 of the tubular body portion 85 cooperates along the rear portion 96B thereof, and portions of the front portion 96A thereof, to provide a generally U-shaped configuration for the upper edge 96 of the tubular body portion 85 of the garment 80 extending between the laterally spaced-apart connecting locations of the first and second fasteners 100, 102. Thus, the garment 80 is configured to couple to the bra 10 at the first and second support strap 40, 42 of the bra 10 at the front panel 82 of the garment 80, and is configured to drape along the upper edge 96 thereof from the first fastener 100 of the front panel 82, to the rear panel 84, and back to the front panel 82 at second fastener 102 in a generally U-shaped configuration. In this way, the garment 80 provides for a covering for the bra 10 that substantially conceals the front portion of the bra 10 while leaving the adjustable first and second support straps 40, 42 accessible for any adjustment. As further shown in FIG. 3, a portion of the rear portion 34 of the body strap 30 is positioned above the rear portion 96B of the upper edge 96 of the tubular body portion 85 of the garment 80. Thus, the present configuration also leaves the rear portion 34 of the body strap 30 accessible for adjustment by the wearer. As shown in FIG. 3, the rear panel 84 of the garment 80 is free of any attachment clips, fasteners, straps or other like coupling mechanism along the rear portion 96B of the upper edge 96 of the tubular body portion 85, such that the rear portion 96B of the upper edge 96 of the tubular body portion 85 is uninterrupted in its U-shaped draping configuration.

Figure 4:
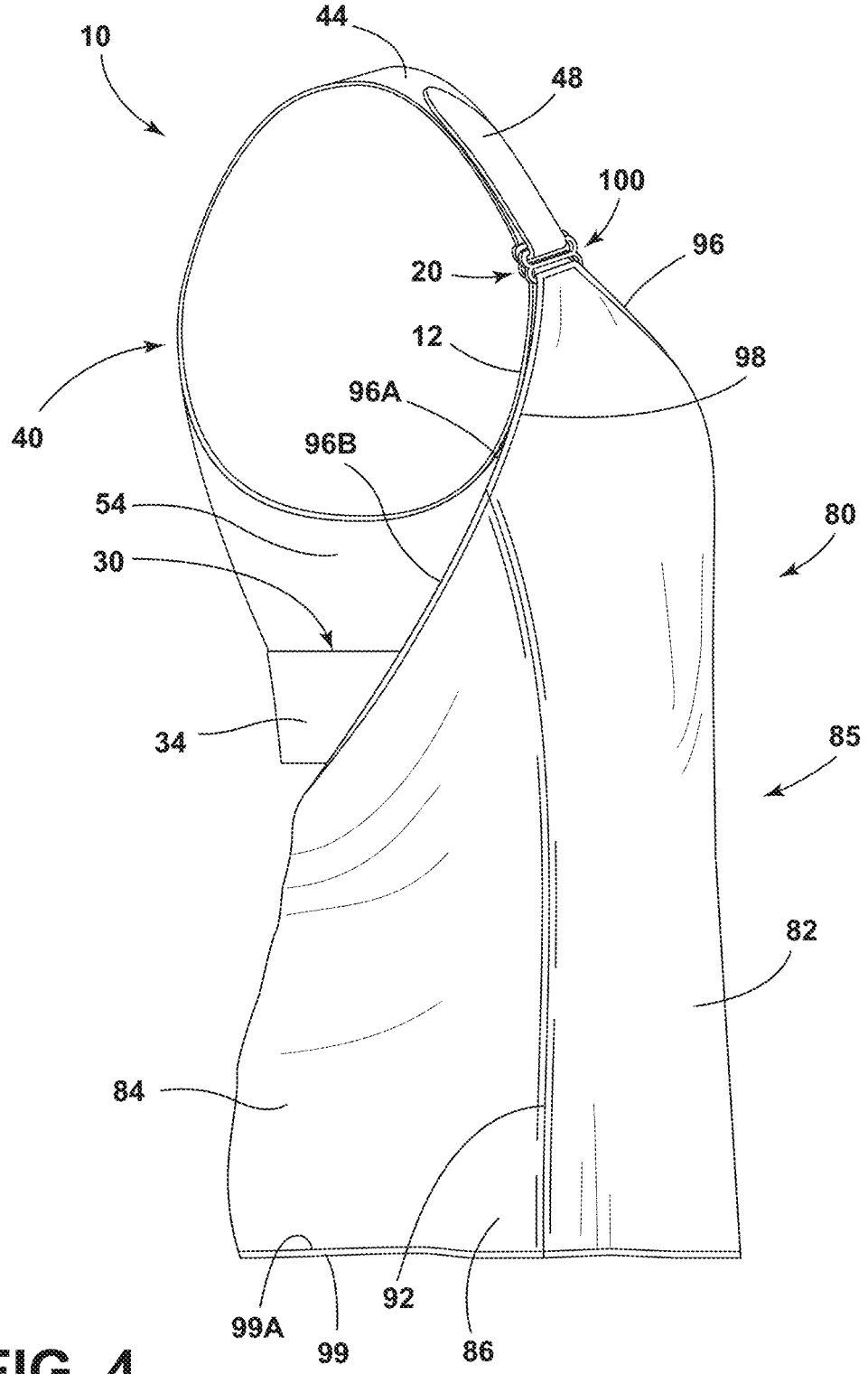
FIG. 4 is a first side elevation view of the brassiere and garment accessory of FIG. 1B.
Figure 5:
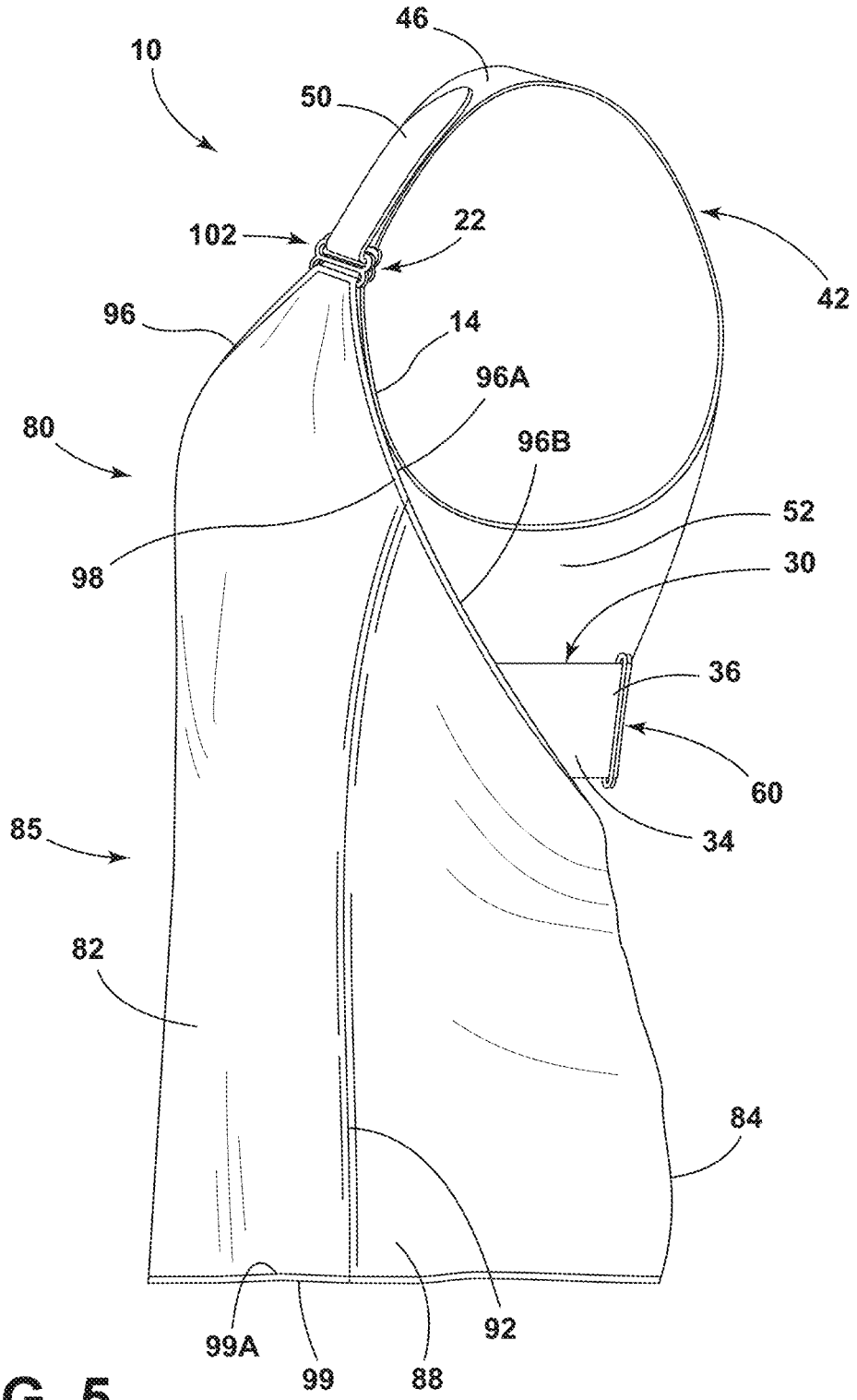
FIG. 5 is a second side elevation view of the brassiere and garment accessory of FIG. 1B.

As further shown in FIG. 3, the side portions 88, 86 of the tubular body portion 85 of the garment 80 are opposed side portions, where the front portion 96A of the upper edge 96 meets with the rear portion 96B of the upper edge 96. The meeting of the front and rear portions 96A, 96B of the upper edge 96 of the tubular body portion 85 of the garment 80 are best shown in FIGS. 4 and 5 at side portions 86, 88, respectively. Thus, the upper edge 96 is disposed in a U-shaped configuration between the opposed side portions 86, 88 of the tubular body portion 85 of the garment 80.

Figure 6:
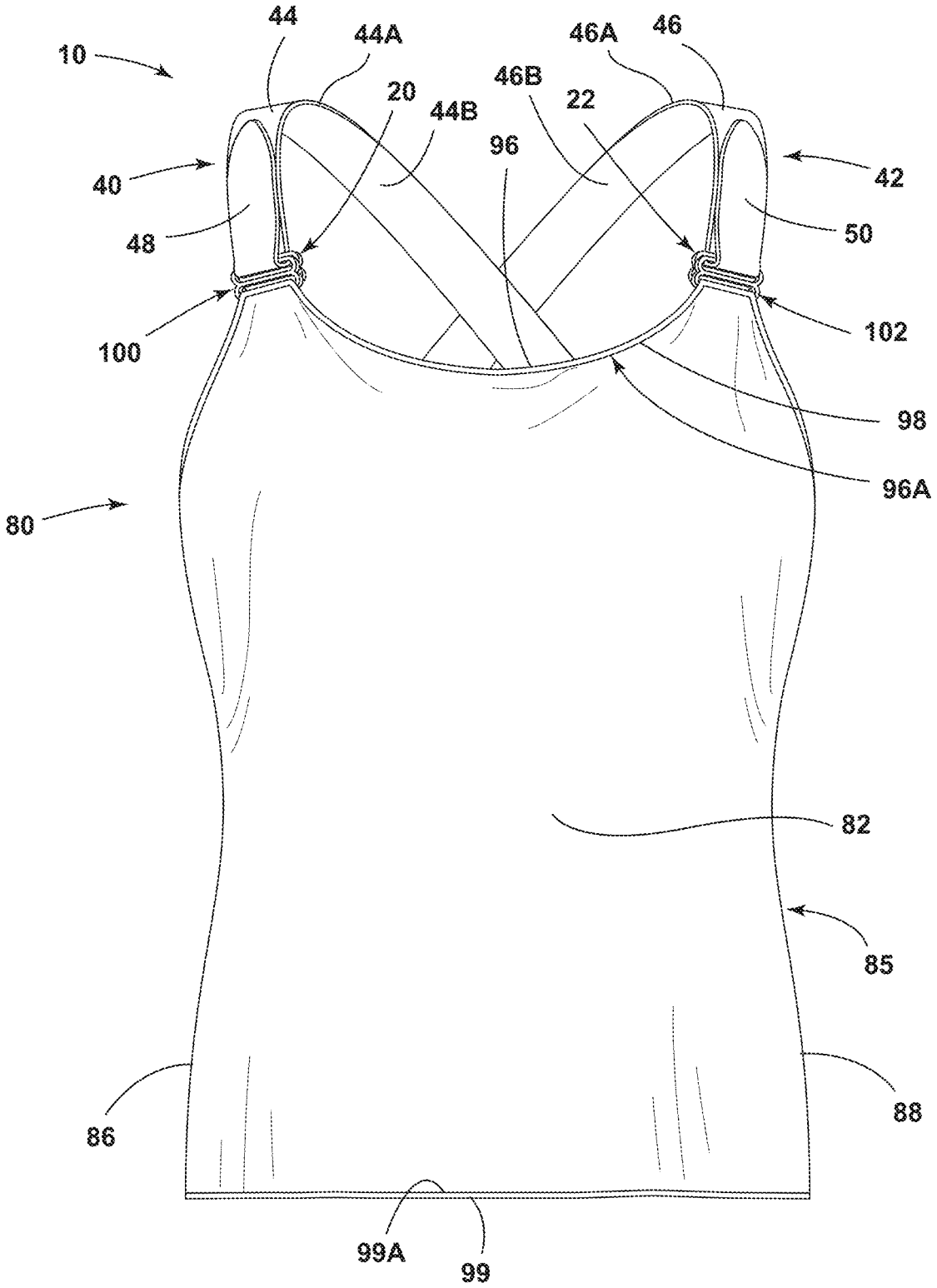
FIG. 6 is a front elevation view of the brassiere and garment accessory of FIG. 1B.

Referring now to FIG. 6, the brassiere and garment system is shown form a front view with the garment 80 suspended from the bra 10 at the first and second fasteners 100, 102 of garment 80 as releasably coupled to the first and second support straps 40, 42 of the bra 10. As shown in FIG. 6, the front panel 82 of the garment 80 substantially conceals the first and second breast cups 12, 14 of the bra 10 when viewed from a front view.

Figure 7:
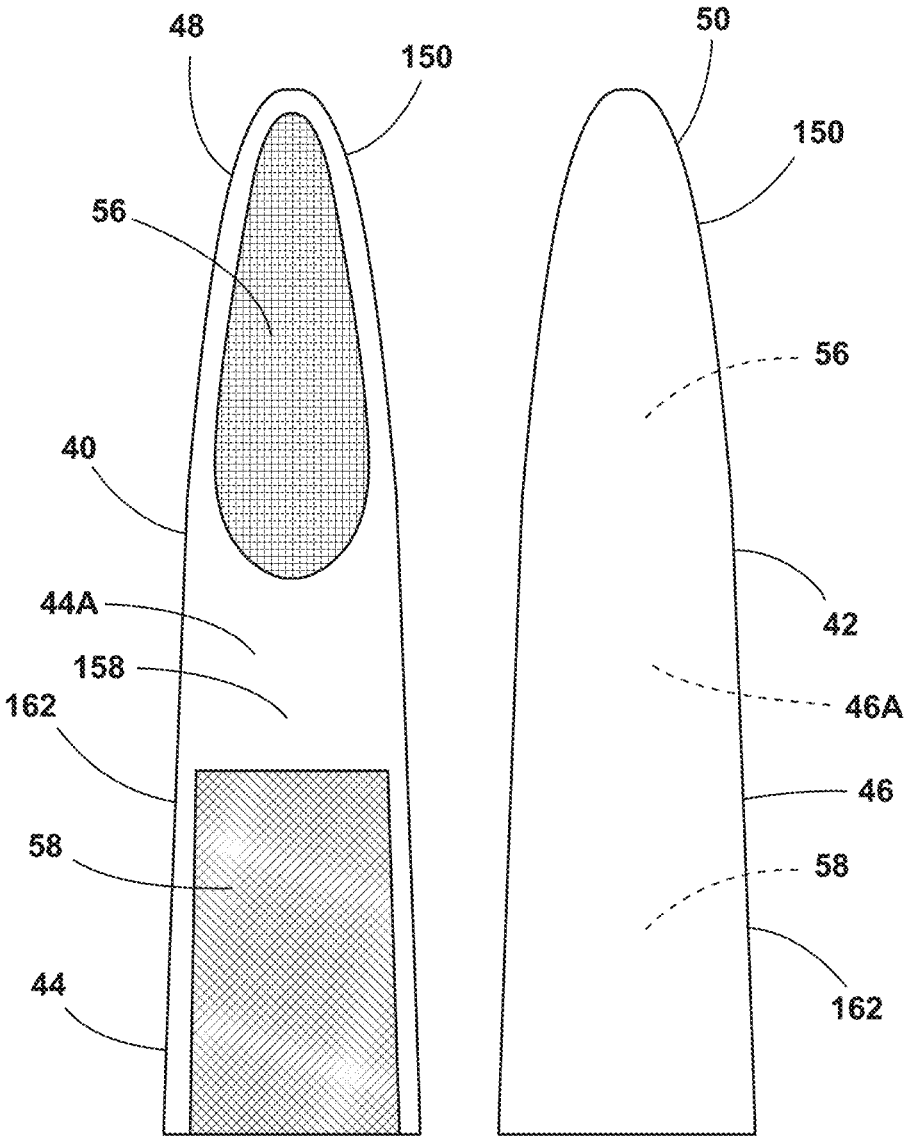
FIG. 7 is an enlarged partial elevational view of a first coupling feature and a second coupling feature of the present disclosure on a laminated support strap.
Figure 8:
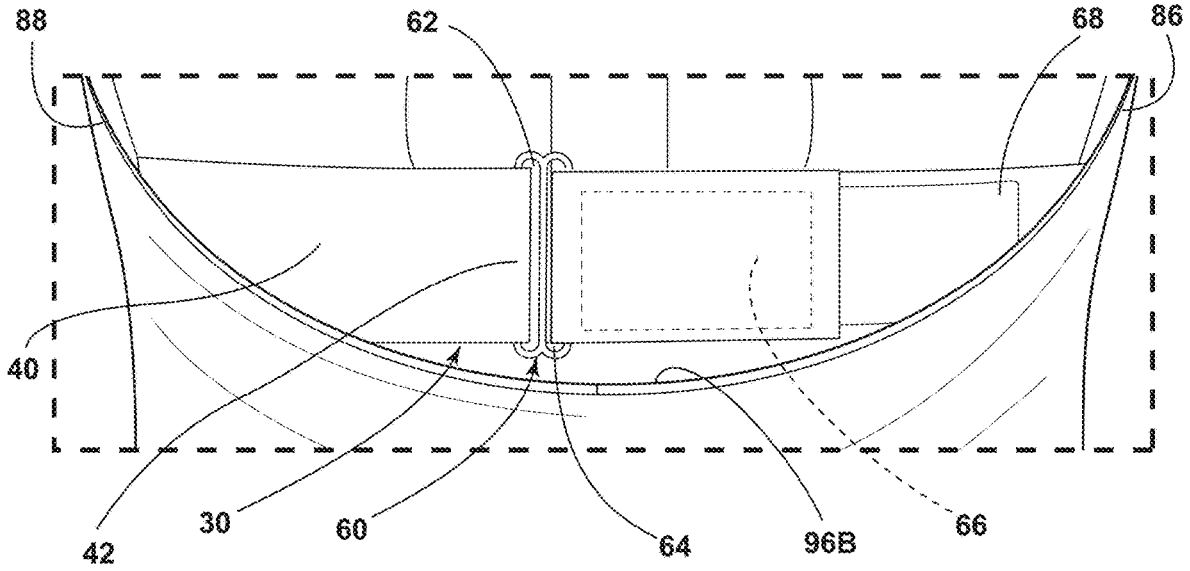
FIG. 8 is an enlarged partial rear elevation view of a body strap of the brassiere and garment accessory taken at area VIII.

Referring now to FIGS. 7 and 8, the free ends 48, 50 of the first and second support straps 40, 42 are illustrated in enlarged and expanded views to exemplarily illustrate the materials which comprise the first and second support straps 40, 42. As mentioned above, the free ends 48, 50 each include the first coupling feature 56. The illustrated free end 48 depicts the first coupling feature 56 as being disposed along a tapered end 150 of the free end 48. However, it is also contemplated that the first coupling feature 56 may extend a greater length or lesser length than that depicted along the free ends 48, 50 of the first and second support straps 40, 42. Although not depicted, the configuration of the free end 50 of the second support strap 42 is similar to that illustrated in FIG. 7 with respect to the free end 48 and the first support strap 40. It is generally contemplated that the free ends 48, 50 may be tapered or may be any other shape generally known in the art. In either configuration, the first and second coupling features 56, 58 are depicted as being disposed along the first sides 44A, 46A of the first and second support straps 40, 42. The first and second support straps 40, 42 are laminated, such that the aesthetic appearance and overall integrity of the first and second support straps 40, 42 is maintained during the repeated coupling and uncoupling of the first coupling feature 56 of the free ends 48, 50 to the second coupling feature 58 along the respective body portions 44, 46.

The term "laminated" and "lamination" as used herein refers to the fusing of multiple units including, but not limited to, materials, adhesives, fabrics, and/or textiles under high pressure and heat to define a singular unitary unit from multiple units, such that the singular unit is free from seams, stitching, or other fastening mechanisms. For example, when multiple units are "laminated" together each unit is generally integrally formed with the other unit(s) in cross-section, such that there is a single, unitary, "laminated" unit, described below.

Figure 9:
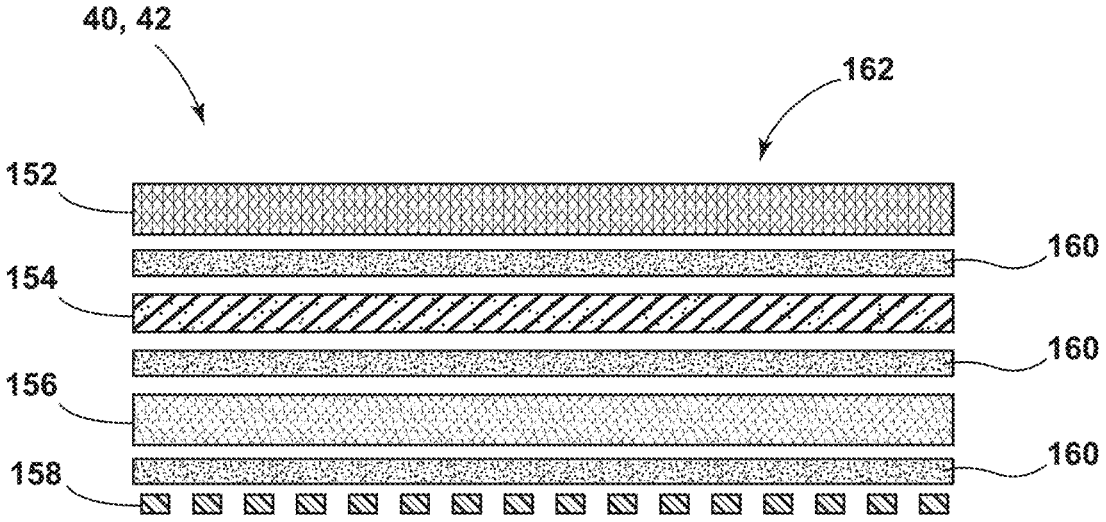
FIG. 9 is a schematic view of the laminated support strap of FIG. 7 including a first fabric, a flexibly resilient material, a second fabric, and fastening material interspaced with adhesive.

The first and second support straps 40, 42 are generally free from seams or other threaded fasteners, such as stitching. As depicted in FIG. 9, the first and second support straps 40, 42 include approximately four layers of material that include a first fabric 152, a flexibly resilient material 154, a second fabric 156, and a fastening material 158. It is generally contemplated that the fastening material 158 may include the first coupling feature 56 and the second coupling feature 58. As described further below, the fastening material 158 is generally compacted along each of the first and second support straps 40, 42, such that the fastening material 158 is minimally visible on the first and second support straps 40, 42. Additionally or alternatively, the portion of the fastening material 158 that defines the first coupling feature 56 may be visually distinct from the second coupling feature 58. Further, the fastening material 158 is integrally formed with each of the first and second support straps 40, 42. Stated differently, the first and second coupling features 56, 58 are integrally formed with each of the first and second support straps 40, 42. For example, the second coupling feature 58 may generally form the length of the first sides 44A, 46A.

It is further contemplated that the body strap 30 may also be formed with at least the first fabric 152, the second fabric 156, and the fastening material 158, as illustrated in FIG. 8. As mentioned above, the fastening material 158 generally includes the first and second coupling features 66, 68, and the first and second coupling features 66, 68 can be disposed on the first side 30A of the body strap 30. As described above with respect to the first and second support straps 40, 42, the fastening material 158 is generally compacted along the body strap 30. The compaction of the fastening material 158 may result in at least the second coupling feature 68 being minimally visible on the body strap 30. It is generally contemplated that the first and second coupling features 66, 68 can be integrally formed with the body strap 30, such that the body strap 30 is generally free from seam lines at least with respect to the fastening material 158.

By way of example, not limitation, the fastening material 158 may be a hook and loop fastener, such that the first coupling feature 56 may comprise the hook material of the fastening material 158 and the second coupling feature 58 may include the loop material of the fastening material 158. It is generally contemplated that the first fabric 152 may be a rigid nylon fabric, such as a nylon block tricot, and the second fabric 156 may be a nylon spandex fabric, such as nylon/spandex tricot and/or polyester tricot. However, it is also contemplated that the first fabric 152 may include other practicable fabrics and materials. The flexibly resilient material 154 may include a high density foam, such as memory foam, or other practicable flexibly resilient materials. The flexibly resilient material 154 is generally configured to provide comfort for the user, such that the first and second support straps 40, 42 may be at least partially padded. The flexibly resilient material 154 can generally extend along a length of the first and second support straps 40, 42.

As illustrated in FIG. 9, the first fabric 152, the flexibly resilient material 154, the second fabric 156, and the fastening material 158 are generally interspaced with an adhesive 160. The first support strap 40 is formed by compressing each of the first fabric 152, the flexibly resilient material 154, the second fabric 156, and the fastening material 158 with the adhesive 160 under high heat and pressure. By way of example, and not limitation, the first support strap 40 is compressed by a mechanical press, such that the first fabric 152, the flexibly resilient material 154, the second fabric 156, and the fastening material 158 are all integrally formed, or fused, to define a laminated support strap 162 of the first support strap 40. This process is generally repeated for the formation of the second support strap 42 and includes the same features and construction as described in relation to the first support strap 40. This process by which the first and second straps 40, 42 are formed is a lamination process to create the laminated support strap 162.

The overall singular, integrated laminated configuration of the first and second support straps 40, 42 is defined by laminating the first fabric 152, the flexibly resilient material 154, the second fabric 156, the fastening material 158, and the adhesive 160 into one body to define the laminated strap 162 of each of the first and second support straps 40, 42. Stated differently, the first fabric 152, the flexibly resilient material 154, the second fabric 156, and the fastening material 158 are fused with the adhesive 160 to form the first and second support straps 40, 42. A similar process and construction may be used in formation of the body strap 30. The lamination process may also be defined as subtraction manufacturing, such that multiple individual elements are reduced to a single element. Stated differently, this process may also be referred to as polymeric welding. As mentioned above, the term "laminated" refers to a unitary, integrated feature that has no separation between heat stacked features and does not fray or otherwise separate upon removal of a portion of the laminated feature.

The invention disclosed herein is further summarized in the following paragraphs and is further characterized by combinations of any and all of the various aspects described therein.

According to one aspect of the present disclosure, a garment system including a bra and garment configured to couple to the bra. The bra includes first and second breast cups that are laterally spaced-apart and include respective upper edges. First and second attachment clips are disposed on the upper edges of the first and second breast cups, respectively, and each include a receiving aperture disposed therethrough. A body strap is operably coupled to the first and second breast cups along a front portion of the body strap. The body strap further includes a rear portion configured to extend around a back of a wearer. First and second support straps are respectively attached at one end to the rear portion of the body strap, and each include a free end having a first coupling feature and a body portion having a second coupling feature that is a reciprocal coupling feature to the first coupling feature. The free ends of the first and second support straps are received through the receiving apertures of the first and second attachment clips, respectively, such that the free ends of the first and second support straps can be folded back against themselves. In this way, the first and second coupling features of the first and second support straps can be aligned and releasably couple to one another. The garment includes a tubular body portion having an upper edge extending around the tubular body portion. First and second fasteners are laterally spaced-apart from one another and each include an anchor portion operably coupled proximate to the upper edge of the tubular body portion. The first and second fasteners each include a coupling portion extending upwardly from the anchor portion to define upwardly accessible first and second receiving apertures, respectively. The first and second support straps are received through the first and second receiving apertures, respectively, to releasably couple the garment to the bra.

According to another aspect, the first and second support straps each include first and second sides.

According to another aspect, the first and second coupling features of the first support strap and the second support strap are disposed on the first sides of the first and second support straps, respectively.

According to another aspect, the second coupling feature of the first support strap and the second coupling feature of the second support strap substantially cover the entire first sides of the first and second support straps, respectively.

According to another aspect, the garment includes a front panel, and further wherein the first and second breast cups of the bra are substantially concealed by the front panel.

According to another aspect, the upper edge of the tubular body portion includes a rear portion that drapes in a U-shaped configuration between opposed side portions of the tubular body portion.

According to another aspect, a portion of the rear portion of the body strap is positioned above the rear portion of the upper edge.

According to another aspect, the body strap is an adjustable body strap having first and second coupling features disposed on a single side thereof, wherein the first and second coupling features are configured to releasably couple to one another.

According to another aspect, the first and second fasteners each include a single loop configuration.

According to yet another aspect, the first and second fasteners each include a double loop configuration.

According to another aspect of the present disclosure, a garment includes a front panel and a rear panel operably coupled to one another and cooperating to define a tubular body portion with an upper edge. The upper edge includes front and rear portions. The rear portion of the upper edge is disposed along the rear panel and downwardly drapes between the first and second sides of the tubular body portion. A fastener includes an anchor portion defining a mounting aperture and a coupling portion defining a receiving aperture disposed above the mounting aperture. A material tab includes first and second ends and a body portion disposed therebetween. The first end of the material tab is operably coupled to the tubular body portion proximate the front portion of the upper edge of the tubular body portion. The second end of the material tab is coupled to either the tubular body portion proximate the front portion of the upper edge of the tubular body portion, or the body portion of the material tab itself. The body portion of the material tab is received through the mounting aperture of the fastener.

According to another aspect, the fastener defines a first fastener, and the garment includes a second fastener laterally spaced-apart from the first fastener along the upper edge of the garment.

According to another aspect, the second fastener includes an anchor portion defining a mounting aperture and a coupling portion defining a receiving aperture that is disposed above the mounting aperture of the second fastener.

According to another aspect, the rear portion of the upper edge drapes in a U-shaped configuration.

According to yet another aspect, the U-shaped configuration of the rear portion of the upper edge is uninterrupted.

According to yet another aspect of the present disclosure, a garment includes a tubular body portion having front, rear and opposed side portions and an upper edge extending circumferentially around the tubular body portion. The upper edge includes front and rear portions. First and second fasteners each include an anchor portion operably coupled proximate to the front portion of the upper edge of the tubular body portion at laterally spaced-apart first and second attachment locations, respectively. The first and second fasteners further include coupling portions extending upwardly from the respective anchor portions to define upwardly accessible receiving apertures disposed through the respective coupling portions. The rear portion of the upper edge of the tubular body portion is disposed in a U-shaped configuration between the laterally spaced-apart first and second attachment locations of the first and second fasteners.

According to another aspect, the first and second fasteners each include a single loop configuration.

According to another aspect, the first and second fasteners each include a double loop configuration with mounting apertures disposed below the upwardly accessible receiving apertures.

According to another aspect, the tubular body portion is comprised of front and rear panels operably coupled to one another at side portions thereof.

According to another aspect, the rear panel is free of fasteners.

According to one aspect of the present disclosure, a bra includes first and second cups that are laterally spaced-apart and each have upper edges. A body strap is operably coupled to the first and second cups along a front portion of the body strap. The body strap further includes a rear portion that is configured to extend around a back of a wearer. First and second support straps are respectively coupled at one end to the rear portion of the body strap. The first and second support straps each include a free end having a first coupling feature, and a body portion that has a second coupling feature that is a reciprocal coupling feature to the first coupling feature. The free ends of the first and second support straps can be folded back against the body portions, such that the first and second coupling features of the first and second support straps are aligned and releasably coupled to one another. The first and second support straps further includes first and second fabrics, a flexibly resilient material, and a fastening material that includes the first and second coupling features. The first fabric, the flexibly resilient material, the second fabric, and the fastening material are integrally formed to define a laminated support strap of each of the first and second support straps.

According to another aspect, a first support strap and a second support strap each include a first side and a second side.

According to another aspect, first and second coupling features of a first support strap and a second support strap are disposed on a first side of the first and second support straps, respectively.

According to another aspect, a second coupling feature of a first support strap and a second coupling feature of a second support strap substantially cover a first side of the first support strap and the second support strap, respectively.

According to another aspect, a body strap is an adjustable body strap that has first and second coupling features that are disposed on a single side thereof, and the first and second coupling features are configured to releasably couple to one another.

According to another aspect, a garment includes a tubular body portion and first and second fasteners that are laterally spaced apart, and a first support strap and a second support strap each are operably coupled to the first and second fasteners, respectively.

According to another aspect, first and second support straps are laminated and are free from seams along a free end and a body portion of each of the first and second support straps.

According to another aspect of the present disclosure, a bra assembly includes at least one cup. A body strap is operably coupled to the at least one cup. A first laminated support strap is selectively coupled to the at least one cup. The laminated support strap includes a free end, a body portion that extends from the free end and is coupled to the body strap at an opposing end from the free end, first and second fabrics, and a fastening material. The first fabric, the second fabric, and the fastening material are integrally formed to define the laminated support strap.

According to another aspect, a garment includes a coupling portion that defines upwardly accessible first and second receiving apertures, and a laminated support strap is received through at least one of the first and second receiving apertures, respectively, to releasably couple the garment to at least one cup.

According to another aspect, a body strap is an adjustable body strap that has first and second coupling features that are disposed on a single side thereof, and the first and second coupling features are configured to releasably couple to one another.

According to another aspect, a first coupling feature and a second coupling feature are integrally formed with a body strap to define a laminated body strap.

According to another aspect, a laminated support strap includes a flexibly resilient material that is disposed between a first fabric and a second fabric, and the flexibly resilient material is integrally formed with each of the first fabric, the second fabric, and a fastening material.

According to another aspect, a fastening material includes a first coupling feature and a second coupling feature, and the second coupling feature is a reciprocal coupling feature to the first coupling feature.

According to another aspect, a first coupling feature is integrally formed with a free end of a laminated support strap, and a second coupling feature is integrally formed with a body portion of the laminated support strap.

According to yet another aspect of the present disclosure, a bra includes an adjustable body strap that has a rear portion with first and second coupling features disposed on a single side thereof, and first and second support straps that are respectively coupled at one end to the rear portion of the body strap. Each of the first and second support straps includes a fastening material, first and second fabric materials, and a flexibly resilient material. The first fabric, the flexibly resilient material, the second fabric, and the fastening material are integrally formed to define a laminated support strap of each of the first and second support straps.

According to another aspect, a fastening material includes a first coupling feature and a second coupling feature, and the second coupling feature is a reciprocal coupling feature to the first coupling feature.

According to another aspect, a first support strap and a second support strap each include a free end and a body portion, and a first coupling feature of a fastening material is integrally formed with the free end of each of the first and second support straps.

According to another aspect, a laminated support strap of a first support strap and a second support strap is free from seams.

According to another aspect, a first coupling feature and a second coupling feature of an adjustable body strap are integrally formed with a rear portion to define a laminated body strap of the adjustable body strap.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A bra, comprising:

first and second cups laterally spaced-apart and each having upper edges;

a body strap operably coupled to the first and second cups along a front portion of the body strap, wherein the body strap further includes a rear portion configured to extend around a back of a wearer; and first and second support straps respectively coupled to the rear portion of the body strap, wherein the first and second support straps each include:

a free end having a first coupling feature;

a body portion having a second coupling feature that is a reciprocal coupling feature to the first coupling feature, wherein the free ends of the first and second support straps are configured to fold back against the body portions, such that the first and second coupling features of the first and second support straps are aligned and releasably coupled to one another;

first and second fabrics;

a flexibily resilient material;

a fastening material that includes the first and second coupling features, wherein the first fabric, the flexibily resilient material, the second fabric, and the fastening material are integrally formed to define a laminated support strap of each of the first and second support straps; and a garment including a tubular body portion and first and second fasteners laterally spaced apart, wherein each of the first and second support straps are operably coupled to the first and second fasteners, respectively.

2. The bra of claim 1, wherein the first and second support straps each include first and second sides.

3. The bra of claim 2, wherein the first and second coupling features of the first support strap and the second support strap are disposed on the first sides of the first and second support straps, respectively.

4. The bra of claim 2, wherein the second coupling feature of the first support strap and the second coupling feature of the second support strap substantially cover the first sides of the first and second support straps, respectively.

5. The bra of claim 1, wherein the body strap is an adjustable body strap having first and second coupling features disposed on a single side thereof, wherein the first and second coupling features are configured to releasably couple to one another.

6. The bra of claim 1, wherein the first and second support straps are laminated and are free from seams along the free end and the body portion of each of the first and second support straps.

7. A bra assembly, comprising:

at least one cup;

a body strap operably coupled to the at least one cup; and a laminated support strap selectively coupled to the at least one cup, the laminated support strap including:

a free end;

a body portion extending from the free end and coupled to the body strap at an opposing end from the free end;

first and second fabrics;

a fastening material, wherein the first fabric, the second fabric, and the fastening material are integrally formed to define the laminated support strap; and a garment including a coupling portion that defines upwardly accessible first and second receiving apertures, wherein the laminated support strap is received through at least one of the first and second receiving apertures, respectively, to releasably couple the garment to the at least one cup.

8. The bra assembly of claim 7, wherein the body strap is an adjustable body strap having first and second coupling features disposed on a single side thereof, and wherein the first and second coupling features are configured to releasably couple to one another.

9. The bra assembly of claim 8, wherein the first and second coupling features are integrally formed with the body strap to define a laminated body strap.

10. The bra assembly of claim 7, wherein the laminated support strap includes a flexibily resilient material disposed between the first and second fabrics, and wherein the flexibily resilient material is integrally formed with each of the first fabric, the second fabric, and the fastening material.

11. The bra assembly of claim 7, wherein the fastening material includes a first coupling feature and a second coupling feature, and wherein the second coupling feature is a reciprocal coupling feature to the first coupling feature.

12. The bra assembly of claim 11, wherein the first coupling feature is integrally formed with the free end of the laminated support strap, and wherein the second coupling feature is integrally formed with the body portion of the laminated support strap.

13. A bra, comprising:

an adjustable body strap having a rear portion with first and second ends, wherein the first end of the body strap is coupled to an attachment clip having a receiving aperture, and further wherein the second end of the body strap is received through the receiving aperture of the attachment clip and configured to fold over onto itself to align corresponding first and second coupling features disposed on the second end for releasably coupling to one another;

first and second support straps respectively coupled to the rear portion of the body strap, wherein each of the first and second support straps includes:

a fastening material;

first and second fabrics; and a flexibily resilient material, wherein the first fabric, the flexibily resilient material, the second fabric, and the fastening material are integrally formed to define a laminated support strap of each of the first and second support straps.

14. The bra of claim 13, wherein the fastening material includes a first coupling feature and a second coupling feature, and wherein the second coupling feature is a reciprocal coupling feature to the first coupling feature.

15. The bra of claim 14, wherein each of the first and second support straps include a free end and a body portion, and wherein the first coupling feature of the fastening material is integrally formed with the free end of each of the first and second support straps.

16. The bra of claim 14, wherein the first and second support straps include first and second sides, and wherein the first and second coupling features of the fastening material are integrally formed along the first side of each of the first and second support straps.

17. The bra of claim 13, wherein the laminated support strap of each of the first and second support straps is free from seams.

18. The bra of claim 13, wherein the first and second coupling features of the adjustable body strap are integrally formed with the rear portion to define a laminated body strap of the adjustable body strap.

* * * * *